United States Patent [19]

Redlin et al.

[11] Patent Number: 5,070,795

[45] Date of Patent: Dec. 10, 1991

[54] TABLE EXTENSION APPARATUS

[76] Inventors: Bonnie A. Redlin; Boyd P. Redlin, both of Suite 153, Box 111888, Kamuela, Hi. 96743

[21] Appl. No.: 693,150

[22] Filed: Apr. 29, 1991

[51] Int. Cl.[5] ..... A47B 97/00

[52] U.S. Cl. ..... 108/26; 108/25

[58] Field of Search ..... 108/26, 65, 90, 152, 108/25; 248/311.2

[56] References Cited

U.S. PATENT DOCUMENTS

| | | | |
|---|---|---|---|
| 102,530 | 5/1870 | Gammel | 108/26 |
| 498,064 | 5/1893 | Korb et al. | 108/26 X |
| 1,818,118 | 8/1931 | Deming | 108/26 X |
| 1,910,091 | 5/1933 | Collier | 108/26 X |
| 1,979,301 | 11/1934 | Webb | 108/26 X |
| 2,106,436 | 1/1938 | Pyle | 108/26 X |
| 2,754,167 | 7/1956 | Young | 108/26 X |
| 3,255,719 | 6/1966 | Klavins | 108/26 |
| 3,784,142 | 1/1974 | O'Brien | 108/26 X |
| 4,099,470 | 7/1978 | Cannon, Jr. | 108/26 |

*Primary Examiner*—Peter A. Aschenbrenner
*Attorney, Agent, or Firm*—Leon Gilden

[57] ABSTRACT

An apparatus mounted to a bottom surface of a table, wherein the apparatus includes a support plate and an elongate circuitous pivot leg mounting a support tray member at a forward terminal end of the pivot leg. The pivot leg includes a "U" shaped leg portion to complementarily receive an adjoining table leg from a positioning of the pivot leg within an elongate recess of an associated positioning strut mounted to the adjoining table leg. The support tray includes a plurality of cup receiving apertures and may further include a cylindrical insulative sponge-like cylinder to receive a beverage container therewithin, as well as a freezable gel insert sleeve positionable within the cylinder to provide selective refrigeration of a beverage container mounted within the support tray structure.

7 Claims, 4 Drawing Sheets

PRIOR ART

FIG. 3
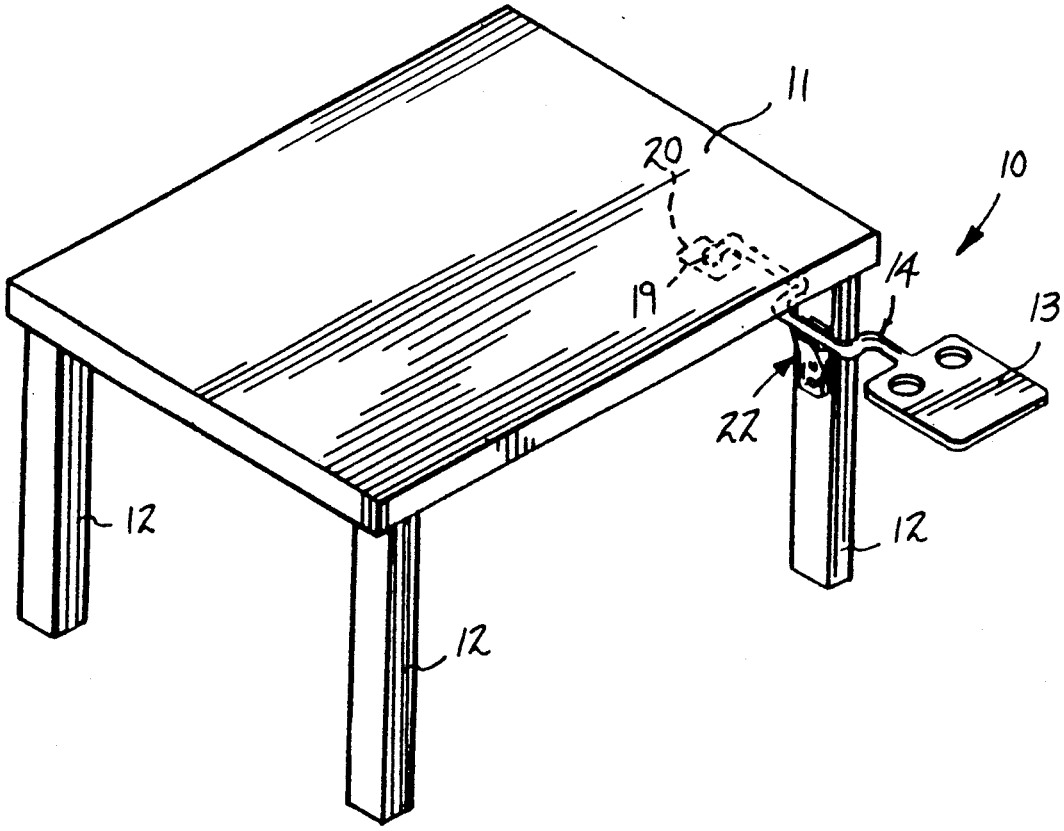
FIG. 4
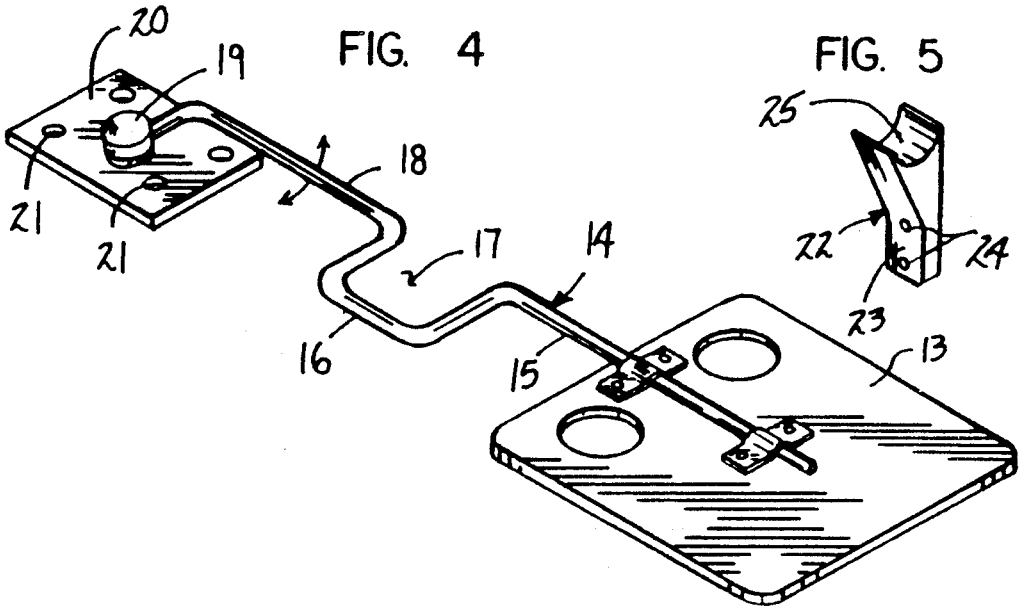
FIG. 5

TABLE EXTENSION APPARATUS

BACKGROUND OF THE INVENTION

1. Field of the Invention

The field of invention relates to tables, and more particularly pertains to a new and improved table extension apparatus to permit convenient positioning and mounting of articles spaced from an associated table surface to limit obstruction of the table surface in use.

2. Description of the Prior Art

Table extension structure for providing additional space relative to an associated table has been utilized in the prior art when it is desirable to require additional space or provide space in a remote relationship relative to a table surface. Such structure may be found in U.S. Pat. No. 3,784,142 to O'Brien wherein a series of shelves are mounted underlying a table surface and selectively extensible relative to the table surface to provide a support for a drinking cup thereon.

U.S. Pat. No. 2,106,436 to Pyle sets forth a table structure wherein a series of tray members are pivotally mounted underlying a table surface and receivable within associated slot structure when in a retracted configuration.

U.S. Pat. No. 4,099,470 provides support structure mounted to each corner portion of an associated table.

U.S. Pat. No. 2,703,266 to Henschel sets forth a retractable article holder that is mounted underlying a table and upon a slide for retraction and extension relative to the table.

U.S. Pat. No. 2,754,167 to Young provides various cart-table extension mounts that are slidably mounted relative to the corner of the table for extension and pivotment relative to the table for support of a cup thereon.

As such, it may be appreciated that there continues to be a need for a new and improved table extension apparatus which addresses both the problems of ease of use as well as effectiveness in construction and in this respect, the present invention substantially fulfills this need.

SUMMARY OF THE INVENTION

In view of the foregoing disadvantages inherent in the known types of table extension apparatus now present in the prior art, the present invention provides a table extension apparatus wherein the same provides an organization that is selectively pivoted relative to an associated table and mounted relative to an adjacent table leg within the table structure. As such, the general purpose of the present invention, which will be described subsequently in greater detail, is to provide a new and improved table extension apparatus which has all the advantages of the prior art table extension apparatus and none of the disadvantages.

To attain this, the present invention provides an apparatus mounted to a bottom surface of a table, wherein the apparatus includes a support plate and an elongate circuitous pivot leg mounting a support tray member at a forward terminal end of the pivot leg. The pivot leg includes a "U" shaped leg portion to complimentarily receive an adjoining table leg from a positioning of the pivot leg within an elongate recess of an associated positioning strut mounted to the adjointing table leg. The support tray includes a plurality of cup receiving apertures and may further include a cylindrical insulative sponge-like cylinder to receive a beverage container therewithin, as well as a freezable gel insert sleeve positionable within the cylinder to provide selective refrigeration of a beverage container mounted within the support tray structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved table extension apparatus which has all the advantages of the prior art table extension apparatus and none of the disadvantages.

It is another object of the present invention to provide a new and improved table extension apparatus which may be easily and efficiently manufactured and marketed.

It is a further object of the present invention to provide a new and improved table extension apparatus which is of a durable and reliable construction.

An even further object of the present invention is to provide a new and improved table extension apparatus which is susceptible of a low cost of manufacture with regard to both materials and labor, and which accordingly is then susceptible of low prices of sale to the consuming public, thereby making such table extension apparatus economically available to the buying public.

Still yet another object of the present invention is to provide a new and improved table extension apparatus which provides in the apparatuses and methods of the prior art some of the advantages thereof, while simultaneously overcoming some of the disadvantages normally associated therewith.

Still another object of the present invention is to provide a new and improved table extension apparatus wherein the same permits positioning of a pivotally extensible table extension support surface or tray member relative to a table surface to provide an accessory mounting surface relative to an associated table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention. FIG. 4 is an isometric bottom view of an example of the instant invention.

FIG. 5 is an isometric illustration of a support strut utilized by the instant invention.

DESCRIPTION OF THE PREFERRED EMBODIMENT

Figure 1:
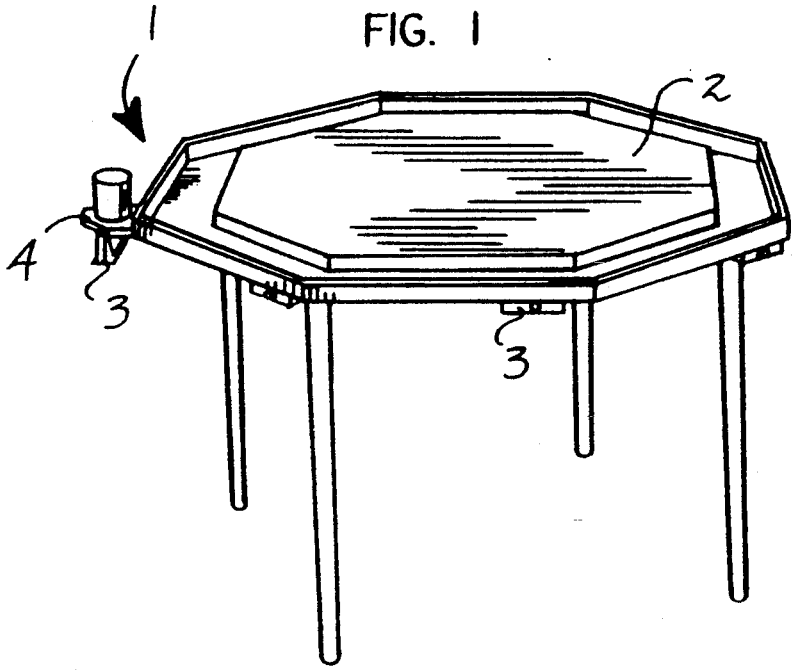
FIG. 1 is an isometric illustration of a prior art table extension apparatus.

With reference now to the drawings, and in particular to FIGS. 1 to 9 thereof, a new and improved table extension apparatus embodying the principles and concepts of the present invention and generally designated by the reference numeral 10 will be described.

Figure 2:
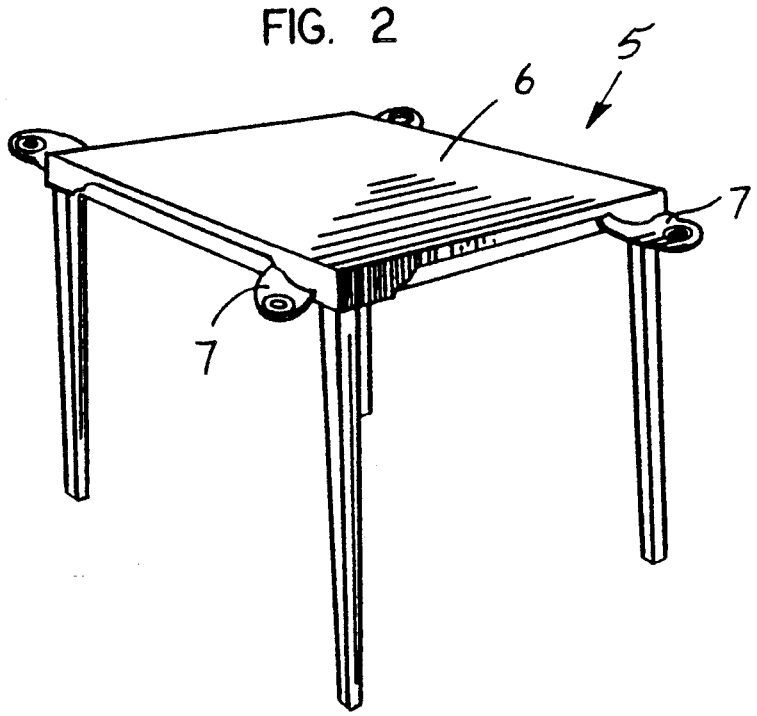
PRIOR ART FIG. 2
FIG. 2 is an isometric illustration of a further prior art table extension apparatus.
Figure 6:
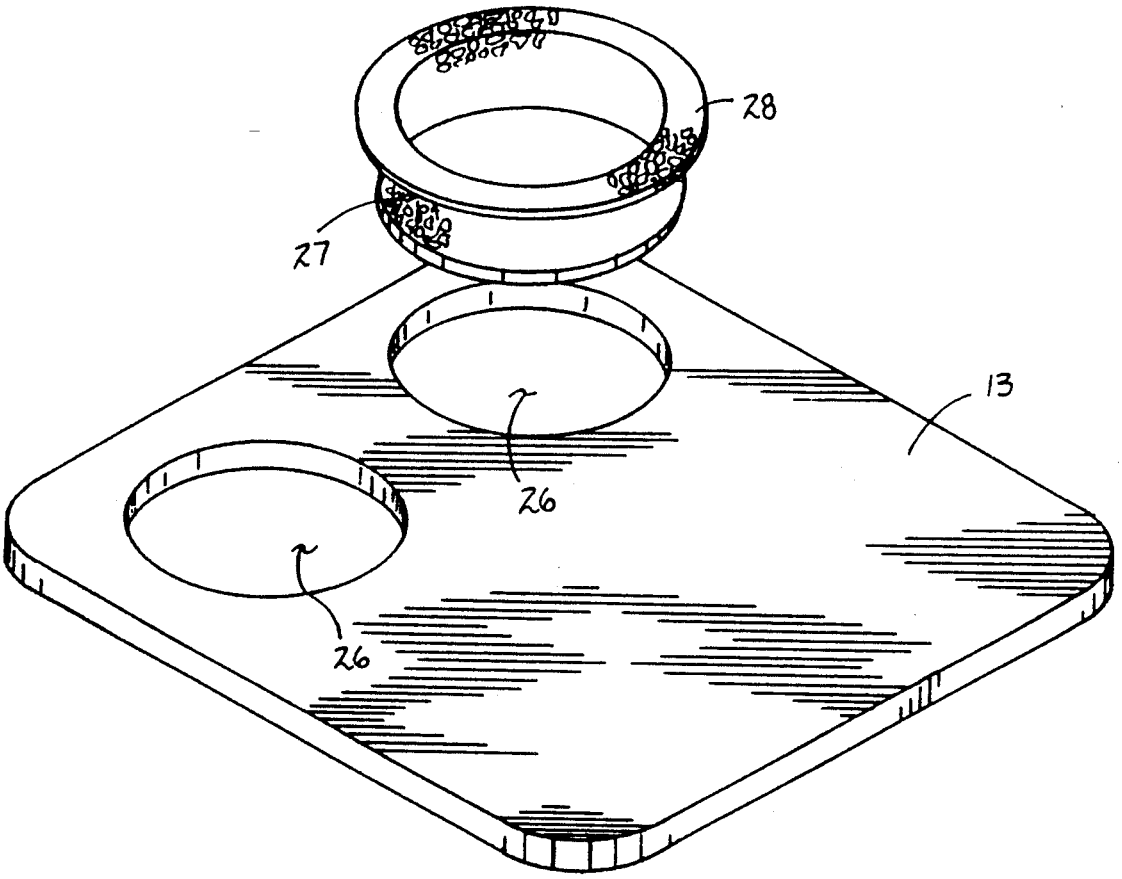
FIG. 6 is an isometric illustration of the tray of the instant invention utilizing an insert therewithin.
Figure 7:
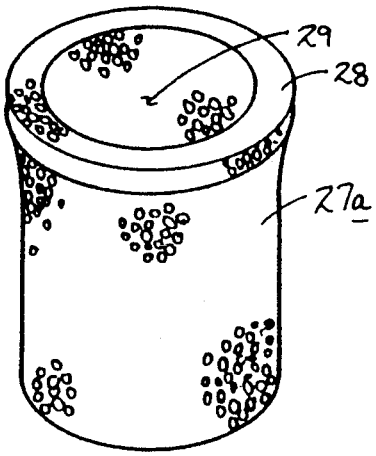
FIG. 7 is an isometric illustration of a further example of an elongate insert utilized by the instant invention.
Figure 8:
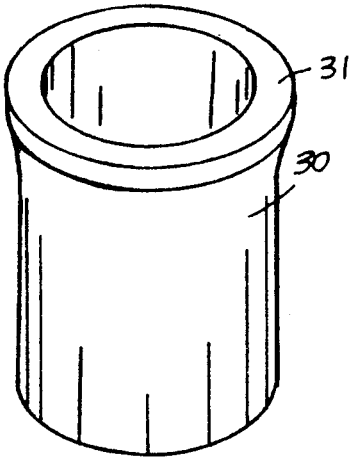
FIG. 8 is an insert sleeve, including a freezable gel in the walls of the insert sleeve, for selective positioning within the container of FIG. 7.
Figure 9:
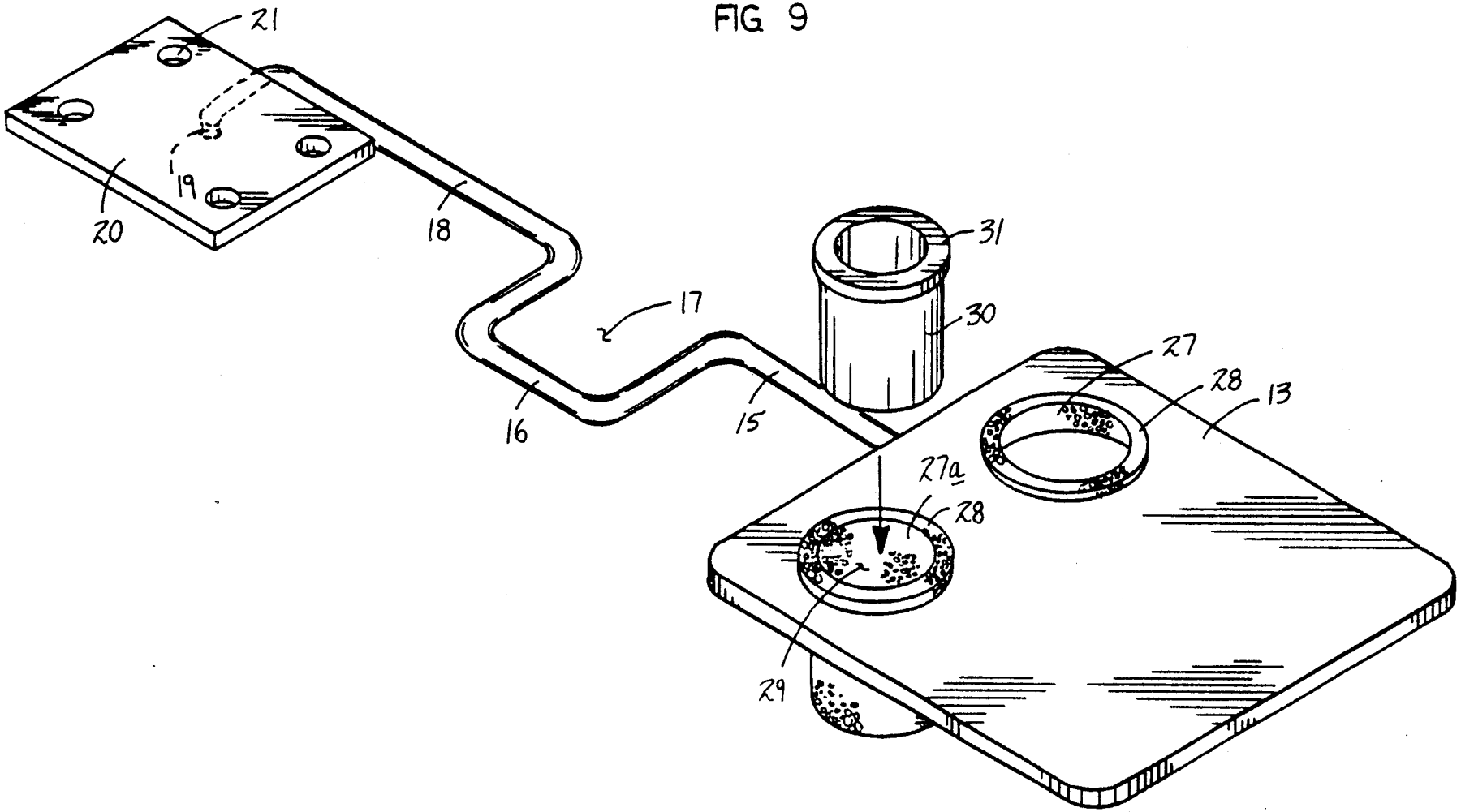
FIG. 9 is an isometric illustration of the instant invention.

FIG. 1 is an isometric illustration of a prior art table extension apparatus 1, wherein a series of members 3 are slidably displaceable from underlying the table to expose a support tray 4 for reception of a cup member thereon. FIG. 2 illustrates a further prior art table extension apparatus 5, wherein the table 6 includes a series of trays 7 pivotally mounted to the table and withdrawn for underlying the table for support of various drinking vessels and the like.

More specifically, the table extension apparatus 10 of the instant invention essentially comprises a table plate 11, including a series of table legs 12 orthogonally mounted integrally to a bottom surface of the table plate 11. A support tray member 13 is illustrated as positioned adjacent one of the table legs, but it is understood that the support tray member and its associated structure may be mounted adjacent each of the table legs 12 in a duplicative manner as required. A pivot leg 14 is mounted to a bottom surface of the support tray member 13 and includes a first linear leg portion 15 directed under the support tray member 13 and extending outwardly therefrom in a generally parallel relationship, wherein a second "U" shaped leg portion 16 defines a recess 17 of a complementary configuration to that defined by the cross-section of an associated table leg 12 to permit reception of the table leg 12 within the recess 17 for anchoring of the pivot leg 14 thereto. A third leg portion 18 in axial alignment with the first leg portion 15 includes a pivot bearing member 19 mounted at its free end remote from the second leg portion 16. The pivot bearing member 19 is orthogonally secured to a bottom surface of a mounting plate 20 and permits rotation of the pivot leg 14 relative to the mounting plate 20 when the mounting plate 20 is secured to a bottom surface of the table plate 11 by fasteners directed through the mounting plate apertures 21 in a conventional fastening manner.

A longitudinally aligned positioning strut 22, as illustrated in FIGS. 3 and 5, includes a lower strut end 23, with a plurality of strut mounting apertures 24 directed therethrough in an orthogonal manner to permit fasteners to secure the positioning strut 22 to an adjacent table leg 12 relative to the second "U" shaped leg portion 16. The positioning strut 22 is arranged in longitudinal alignment with the noted table leg 12, and includes an upper terminal end with an arcuate concave recess 25 to receive the second leg portion 16 therewithin to effect a rest and locking of the pivot leg 14 relative to the table leg 12.

The support tray 13 includes a plurality of tray openings 26 of a predetermined diameter to receive various drinking vessels and the like therewithin. An absorbent sponge-like cylinder 27 with a through-extending bore is positionable within a tray opening 26, and further includes a ring flange 28 of a diameter greater than the predetermined diameter to secure the cylinder 27 within the aperture and provide a moisture absorbing insulative member receiving a beverage container therewithin. A cylindrical cavity 29 is defined by the cylinder 27, wherein an elongate modified cylinder 27 is defined by the same cylindrical cavity 29 of a predetermined cross-sectional configuration. A freezable gel insert sleeve 30 defined by an external diameter substantially equal to the internal diameter of the cylindrical cavity 29 is also provided to provide a refrigerant within the insert sleeve 30. The sleeve 30 is provided with a sleeve ring 31 to overlie the ring flange 28 to position and anchor the freezable gel sleeve 30 within the cylinder 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table extension apparatus comprising, in combination, a table including a plurality of table legs integrally and orthogonally mounted to a bottom surface of the table plate, and at least one mounting plate fixedly mounted to the bottom surface of the table plate adjacent one of the table legs, the mounting plate including a pivot bearing member orthogonally mounted to the mounting plate, and the pivot bearing member arranged for rotation relative to the mounting plate, and a pivot leg mounted to the pivot bearing member, and a positioning strut secured to the at least one table leg for selectively receiving the pivot leg thereon, and a support tray member mounted to a forward distal end of the pivot leg remote from the mounting plate.

2. An apparatus as set forth in claim 1 wherein the pivot leg includes a first axially aligned leg portion fixedly mounted to the support tray member, and the pivot leg further including a second "U" shaped leg portion formed to the first leg portion, wherein the second "U" shaped leg portion includes a recess, the recess is defined by a predetermined configuration, and the table leg is defined by a cross-sectional configuration equal to the predetermined cross-sectional configuration to complementarily position the table leg within the recess, and a third leg portion axially aligned with the first leg portion formed to the second "U" shaped leg portion, with a third leg portion secured to the pivot bearing to permit rotation of the pivot leg relative to the mounting plate.

3. An apparatus as set forth in claim 2 wherein the positioning strut is longitudinally aligned and is arranged parallel to and fixedly secured to the at least one table leg.

4. An apparatus as set forth in claim 3 wherein the positioning strut includes a lower strut end portion, with the lower strut end portion including a plurality of apertures therethrough for securement of the lower end portion to the at least one table leg, and the positioning strut including an upper terminal end, with the upper terminal end including an arcuate recess, with the arcuate recess complementarily receiving the second "U" shaped leg portion therewithin to align and anchor the pivot leg relative to the at least one table leg.

5. An apparatus as set forth in claim 4 wherein the support tray member includes a plurality of openings orthogonally directed therethrough for mounting of beverage containers therewithin.

6. An apparatus as set forth in claim 5 including an elongate absorbent axially aligned cylinder positionable within at least one of the openings, the cylinder including a flange at an upper terminal end thereof, wherein the flange is defined by a flange diameter, and the sponge-like cylinder is defined by a predetermined diameter, with the flange diameter greater than the predetermined diameter to secure the flange diameter to an upper surface of the support tray member.

7. An apparatus as set forth in claim 6 further including a freezable gel insert sleeve, the insert sleeve including a freezable get component therewithin and defined by an external diameter equal to an internal diameter defined by a cylindrical cavity directed through the cylinder.

* * * * *